US005635676A

United States Patent [19]

Piriz

[11] Patent Number: 5,635,676

[45] **Date of Patent: *Jun. 3, 1997**

[54] COMPRESSION CONNECTORS

[75] Inventor: Jose M. Piriz, Collierville, Tenn.

[73] Assignee: Thomas & Betts Corporation, Memphis, Tenn.

[ * ] Notice: The term of this patent shall not extend beyond the expiration date of Pat. No. 5,396,033.

[21] Appl. No.: 275,115

[22] Filed: Jul. 14, 1994

Related U.S. Application Data

[63] Continuation-in-part of Ser. No. 987,944, Dec. 9, 1992, Pat. No. 5,396,033.

[51] Int. Cl.[6] ..... H01R 4/18

[52] U.S. Cl. ..... 174/84 C; 174/94 R

[58] Field of Search ..... 174/84 C, 94 R, 174/71 R; 439/877; 403/275, 391; 29/863, 872

[56] References Cited

U.S. PATENT DOCUMENTS

| | | | |
|---|---|---|---|
| 2,964,585 | 12/1960 | Nilsson et al. | 174/94 R |
| 3,032,603 | 5/1962 | Whitley | 174/94 R |
| 3,156,764 | 11/1964 | Toedtman | 174/94 R |
| 3,235,654 | 2/1966 | Eldridge, Jr. | 174/94 R |
| 3,236,938 | 2/1966 | Toedtman | 174/94 R |
| 3,322,888 | 5/1967 | Zemels | 174/94 R |
| 3,330,903 | 7/1967 | Holke et al. | 174/94 R |
| 3,354,517 | 11/1967 | Levinsky | 24/123 |
| 3,546,366 | 12/1970 | Toedtman et al. | 174/94 R |
| 3,781,459 | 12/1973 | Peek | 174/94 R |
| 4,940,856 | 7/1990 | Bock | 174/94 R |
| 5,103,068 | 4/1992 | Schrader | 174/94 R |
| 5,162,615 | 11/1992 | Schrader et al. | 174/94 R |
| 5,200,576 | 4/1993 | Schrader et al. | 174/94 R |
| 5,396,033 | 3/1995 | Piriz et al. | 174/94 R |

FOREIGN PATENT DOCUMENTS

| | | | |
|---|---|---|---|
| 2011859 | 10/1979 | Germany | 174/94 R |
| 1434954 | 5/1976 | United Kingdom | 174/94 R |

*Primary Examiner*—Kristine L. Kincaid
*Assistant Examiner*—Marc D. Machtinger
*Attorney, Agent, or Firm*—Michael L. Hoelter; Salvatore J. Abbruzzese

[57] ABSTRACT

A compression connector accommodates an electrical conductor for crimping connection therein. The connector includes a connector body having a nest defined by a bottom wall and an opposed pair of upstanding sidewalls. The sidewalls are inwardly deformable upon application of a crimping force. A non-bendable die engagement extent is attached to the sidewall by a weakened portion thereof. Upon application of a crimping force the die engagement extent is cause to deform prior to the deformation of the other sidewall. This permits the sidewalls to overlap around the conductor during crimping.

10 Claims, 3 Drawing Sheets

COMPRESSION CONNECTORS

This is a continuation-in-part of application Ser. No. 07/987,944 filed Dec. 9, 1992 and entitled "H-Tap Compression Connector", now U.S. Pat. No. 5,396,033.

FIELD OF THE INVENTION

The present invention relates generally to compression type connectors for connecting electrical conductors. More particularly the present invention relates to improvements in compression electrical connectors, which may be more reliably crimped around electrical conductors using a suitable crimping tool.

BACKGROUND OF THE INVENTION

Compression connectors for connecting together two or more electrical conductors are well-known. Connectors such as these typically accommodate stripped electrical conductors in individual connector nests. A suitable crimping tool is used to crimp the connector around the conductors. Many of these compression-type connectors are of the H-tap variety, that is the connector body has an H-shaped cross section. H-taps provide upper and lower conductor nests, each nest being defined by a bottom wall and opposed upstanding sidewalls. The sidewalls are adapted to be deformed upon application of a crimping force applied by a crimping tool to draw the sidewalls around the conductor to thereby compress the conductor within the nest of the H-tap.

In U.S. Pat. No. 2,964,585, an H-tap compression connector is shown. The upper ends of the sidewalls are dimensioned to have relatively equal lengths so that upon crimping, the upper edges may not completely encircle the conductor. An attempt to lengthen the sidewalls could result in the sidewalls contacting each other during crimping prior to encircling the conductor thereby resulting in an ineffective crimp.

Attempts to solve this problem are seen in U.S. Pat. No. 3,235,654 where a bendable tab is provided at the outer edge of one of the sidewalls. Once the conductor is inserted in the nest the bendable tab may be manually folded over the conductor so that during crimping the conductor is entirely enclosed. Other examples of such connectors are shown in U.S. Pat. Nos. 3,354,517, 3,330,903 and 3,322,888.

Improvements in bendable tab H-taps are shown in U.S. Pat. No. 3,236,938. The bendable tab is modified to include a longitudinal ridge on the exterior surface thereof. This assures that the tab is bent inwardly of the opposed sidewall.

However, it can be seen that employing extending bendable tabs such as those described above greatly increases the cost of the connector as well as complicates the crimping operation by interposing the installer-dependent step of manually bending the tab prior to crimping.

A further attempt to provide a completely enclosed crimp in an H-tap is shown in U.S. Pat. No. 5,162,615 where an H-tap is provided having upstanding sidewalls of sufficient length to entirely encircle the conductor. In order to avoid the problem of the walls engaging one another prior to full crimping, the '615 provides one sidewall having an inwardly curled upper extent. Thus, upon application of a crimping force, the inwardly curled extent will cause the one sidewall to deform prior to the other sidewall so that the sidewalls overlap about the conductor. While this solves the problem of encircling the conductor, it has been found that the construction shown in the '615 patent is limited in the range of conductor sizes which may be accommodated therein.

Also, the curled upper extent may unduly restrict conductor insertion access to the nest.

It is, therefore, desirable to provide a compression connector which will permit the reliable overlapping of the sidewalls of the nest during crimping and accommodate a range of conductor sizes therein.

SUMMARY OF THE INVENTION

It is an object of the present invention to provide an electrical connector for crimping about an electrical cable.

It is a further object of the present invention to provide compression connection which fully encircles the conductor upon crimping.

It is a still further object of the present invention to provide a compression connector having non-bendable sidewalls where one sidewall is designed to reliably deform prior to the other sidewall to permit overlapping crimping around a conductor.

It is yet another object of the present invention to provide a compression conductor having a conductor nest which accommodates a range of conductor sizes.

In the efficient attainment of these and other objects, the present invention provides an electrical connector for crimping about an electrical conductor. The connector includes a body having a nest for receipt of the conductor. The nest includes a bottom wall and an opposed pair of upstanding sidewalls. One of the sidewalls includes a non-bendable initial die engagement extent which extends toward the other sidewall. The die engagement extent is attached to the sidewall by a weakened portion which facilitates crimping deformation of the sidewall thereat, upon application of a crimping force. This one sidewall deforms prior to the other sidewall upon the application of the crimping force.

As shown by way of the preferred embodiment herein, the die engagement extent includes a rib extending outwardly therefrom and is engagable with the die of a crimping tool to cause the weakened portion to initially deform and the die engagement extent to move toward the conductor nest so that the other sidewall overlaps the die engagement extent upon crimping.

DETAILED DESCRIPTION OF THE PREFERRED EMBODIMENT

Figure 1:
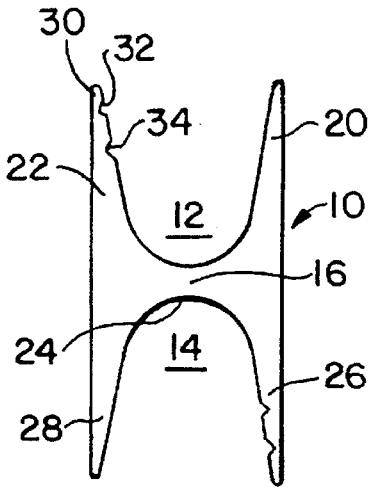
FIG. 1 is a front plan view of an H-tap electrical compression connection of the present invention.

Referring to FIG. 1, an H-tap compression connector 10 of the present invention is shown. Connector 10 is formed of a suitably conductive metal such as copper and is cut from an extruded length. Copper is selected as the preferable material for its high electrical conductivity as well as its ability to be suitably crimped by a crimping tool (not shown). It is, however, understood that other conductive metals such as aluminum may be employed and other forming techniques such as casting may also be used to form the connector of the present invention.

Figure 2:
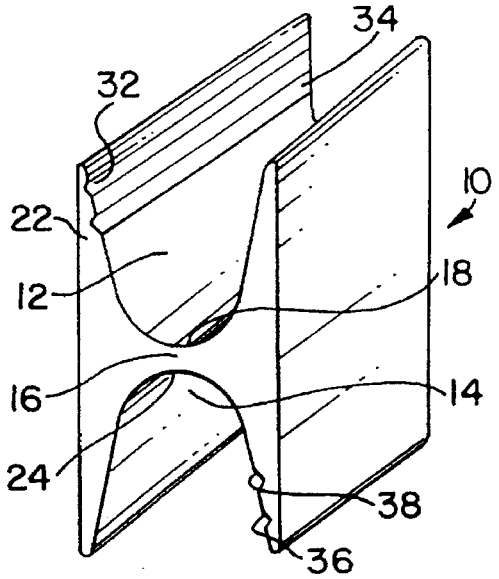
FIG. 2 is a perspective showing of the connector of FIG. 1.

Connector 10 has a generally H-shaped crosssection providing oppositely directed upper and lower conductor receiving nests 12 and 14. These nests, 12 and 14, are separated by cross member 16 of the H-shaped connector. Conductor receiving nest 12 is defined by the bottom wall 18 and a pair of opposed upstanding sidewalls 20 and 22. Likewise, nest 14 is defined by bottom wall 24 and opposed sidewalls 26 and 28. While FIGS. 1 and 2 show compression connectors having generally an H-shaped configuration, it is also contemplated that other shapes (FIG. 8) may be employed in accordance with the present invention.

Figure 4:
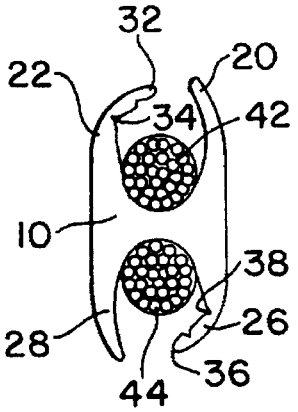
FIGS. 4–6 show in succession the H-tap compression connection of FIG. 1 being crimped about a pair of electrical conductors.
Figure 5:
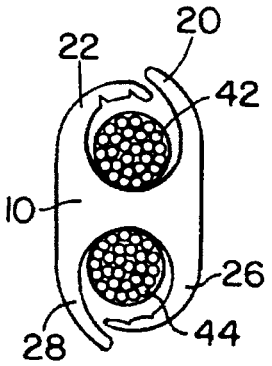
Figure 9:
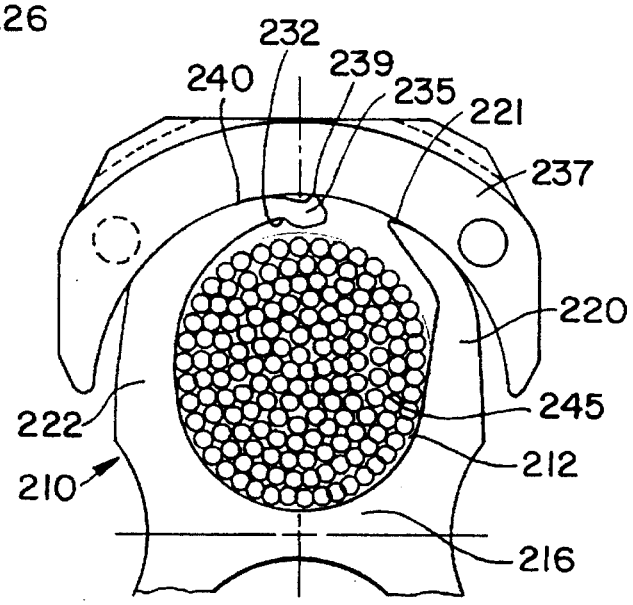
FIGS. 9 and 10 show an upper portion of the compression connector of FIG. 8, progressively crimped within the dies of a crimping tool.
Figure 10:
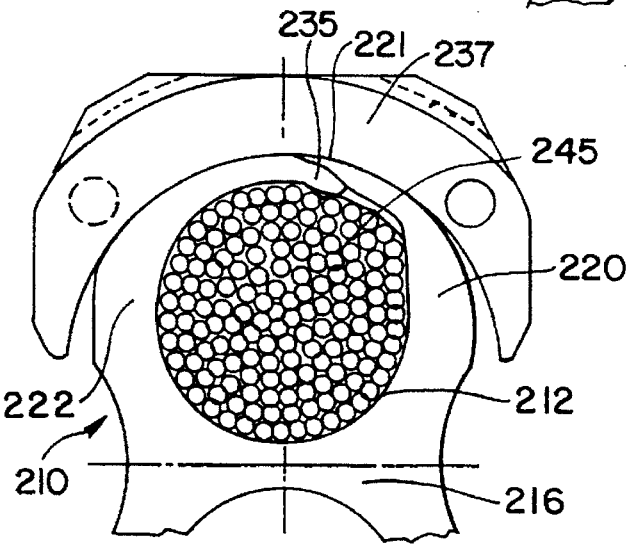

As may be appreciated, the size and Shape of connector 10 may be varied to accommodate various lengths and thicknesses (diameters) of cable. However, the sidewalls 20, 22, 26 and 28 are selected such that when a conductor is placed in nests 12 and 14 and suitably crimped, legs 20 and 22 will overlap each other as will legs 26 and 28 to encircle the conductors supported within the nests 12 and 14. In a typical crimping process, a suitable crimping tool (not shown) is employed. With respect to nest 12, upstanding sidewalls 20 and 22 are deformed inwardly by the crimping tool. Suitable crimping dies, such as those shown in FIGS. 7–11, force the sidewalls around the conductor supported within the nest 12. The upstanding sidewalls 20 and 22 are directly engagable by the dies of the crimping tool. As shown in FIGS. 9 and 10, the dies are movable directly into engagement with the sidewalls to progressively deform the sidewalls (FIGS. 4–5). In this regard the sidewalls are deformable upon a force applied by the crimping tool. The sidewalls of the connector are non-bendable that is, they cannot be manually bent by the installer. This eliminates the need for an extra installation step required by prior art devices.

In order to assure that one sidewall overlaps the other sidewall upon crimping, the present invention contemplates providing a weakened portion on one of the sidewalls so that during the crimping operation it will deform prior to deformation of the other sidewall.

Figure 3:
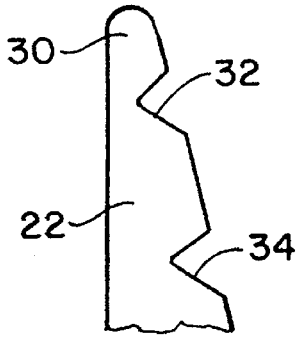
FIG. 3 is an enlarged showing of an outer extent of one sidewall of the connector shown in FIG. 1.

Referring additionally to FIG. 3, an upper extent 30 of sidewall 22 is shown. Upper extent 30 includes a pair of vertically spaced longitudinal grooves 32 and 34 extending along the inside surface thereof. Grooves 32 and 34 provide an area of reduced thickness for sidewall 22 thereby weakening the strength of the sidewall. Grooves 32 and 34 are generally V-shaped notches and provide a thinned wall area at upper extent 30. The shape of the notches formed by grooves 32 and 34 are conducive to collapsing upon compression, thereby driving inwardly extent 30 of sidewall 22. Upon application of a uniform crimp force to both sidewalls 20 and 22, grooves 32 and 34, having weakened the upper extent 30 of sidewall 22, will, therefore, cause sidewall 22 to deform prior to the deformation of sidewall 20. As seen in FIGS. 1 and 2, sidewall 26 forming part of nest 14 includes similar grooves 36 and 38 thereon which serve a purpose similar to that described above.

Figure 6:
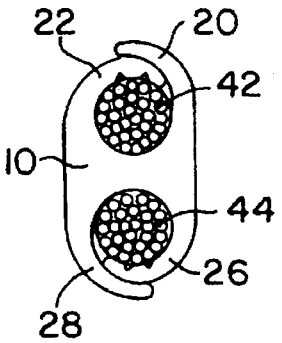

Referring now to FIGS. 4, 5 and 6, the successive steps in the crimping cycle may be seen. Stripped electrical conductors 42 and 44 are supported within nests 12 and 14 respectively. A conventional crimping tool (not shown) having dies such as those shown in FIGS. 7-11, specifically designed for crimping compression connectors, exerts a uniform crimping force on sidewalls 20 and 22 as well as sidewalls 26 and 28 so that a compression connection is achieved between conductors 42 and 44. Upon application of the uniform crimping force, sidewalls 22 and 26 will inwardly deform just prior to the inward deformation of sidewalls 20 and 28. As can be seen in FIG. 4, the above-described grooves 32, 34, 36 and 38 provide a weakened section about which crimping deformation is more easily achieved. Continued application of the crimping force causes sidewalls 22 and 26 to wrap around conductors 42 and 44 respectively. Referring to FIG. 6, sidewalls 20 and 28 are then forced over deformed sidewalls 22 and 26 respectively to overlap conductors 42 and 44 thus achieving a compression connection which encircles the conductors.

Figure 7:
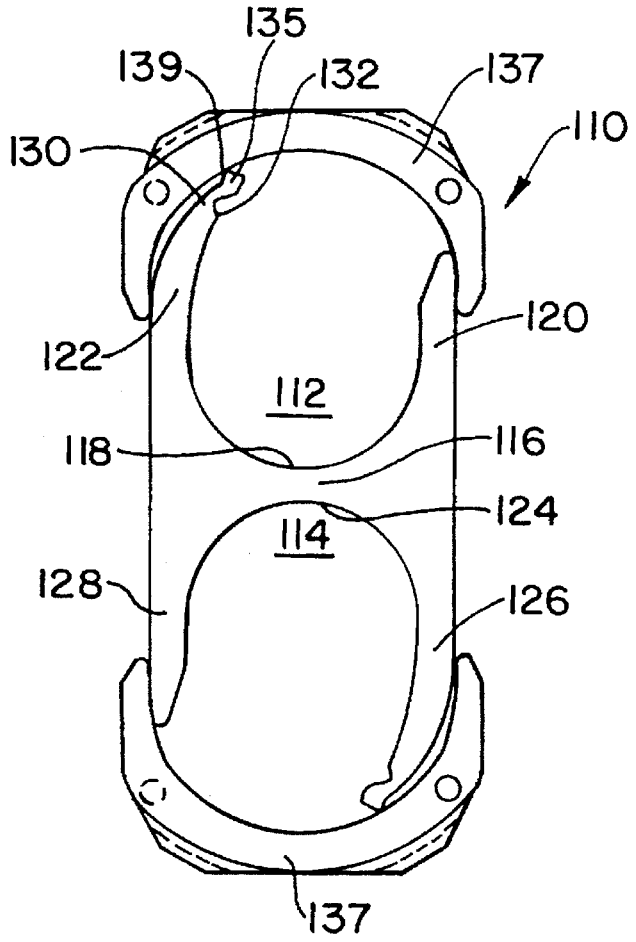
FIG. 7 shows a further embodiment of an improved compression connector of the present invention supported between the dies of a crimping tool.

A further embodiment of the present invention is shown in FIG. 7. H-tap compression connector 110 is formed in accordance with the present invention. Connector 110 is of similar construction to that of connector 10 described above and has a generally H-shaped cross-section providing oppositely directed upper and lower conductive receiving nests 112 and 114 separated by a cross member 116. Conductor receiving nest 112 is defined by a bottom wall 118 and a pair of upstanding sidewalls 120 and 122. Similarly, nest 114 is defined by bottom wall 124 and opposed sidewalls 126 and 128. Diametrically opposed sidewalls 122 and 126 are constructed to have lengths measured from cross member 116 which are longer than opposed sidewalls 120 and 128.

For ease of description reference will now be made to nest 112 at the upper half of connector 110. It is understood that the lower half of connector 110 is formed in the same manner. Longer sidewall 122 is inwardly curved at a distal extent 130. In a manner similar to that described above with respect to connector 110, distal extent 130 includes a longitudinal groove 132 extending along an insider surface thereof. Groove 132 provides an area of reduced thickness for sidewall 122, thereby weakening the strength of the sidewall thereat. In the present illustrative embodiment, groove 132 is generally formed by a v-shaped notch to provide such weakened portion. A die engagement extent 135 is provided adjacent distal extent 130 and is separated from the remainder of sidewall 122 by groove 132. Die engagement extent 135 extends toward the other sidewall 120 a small distance following the general curvature of the distal extent 130 of sidewall 122. The distance that die engagement extent 135 extends towards opposed sidewall 120 is sufficiently small so as to permit unimpeded insertion of a conductor (FIGS. 4–6) into nest 112. Thus nest 112 remains substantially open-ended permitting ease of insertion of the conductor thereinto. While die engagement extent 135 is supported to the remainder of sidewall 122 at groove 132, die engagement extent 135 remains non-bendable. That is, the formation of die engagement extent 135 is sufficiently rigid to resist manual bending of sidewall 122 thereat prior to application of a crimping force by opposed dies 137 of a crimping tool (not shown).

Die engagement extent 135 being positioned at the distal end of longer sidewall 122, contacts the interior surface of die 137 prior to crimping engagement of die 137 with opposed sidewall 120. Thus, the combination of the formation of a weakened portion of sidewall 122 by groove 132 and that the sidewall 122 is constructed to be longer than opposed sidewall 120, causes sidewall 122 to deform prior to opposed sidewall 120 upon application of a crimping force. This facilitates the ability of sidewall 122 to be overlapped by opposed sidewall 120 upon crimping thereof around a conductor supported in the nest 112.

In order to assure that sidewall 120 overlaps at least a portion of opposed sidewall 122, die engagement extent 135 includes a die engagement rib 139 which extends outwardly from the sidewall 122. Die engagement rib 139 extends into contact engagement with the inner surface of die 137 to make initial contact therewith upon crimping movement of die 137. The engagement of die 137 with rib 139 causes the weakened portion of sidewall 122 to deform thereat and move inwardly towards conductor nest 112. As will be described in further detail with respect to additional embodiments described herein, this causes sidewall 120 to overlap die engagement extent 135 upon crimping about a conductor supported within nest 112.

Figure 8:
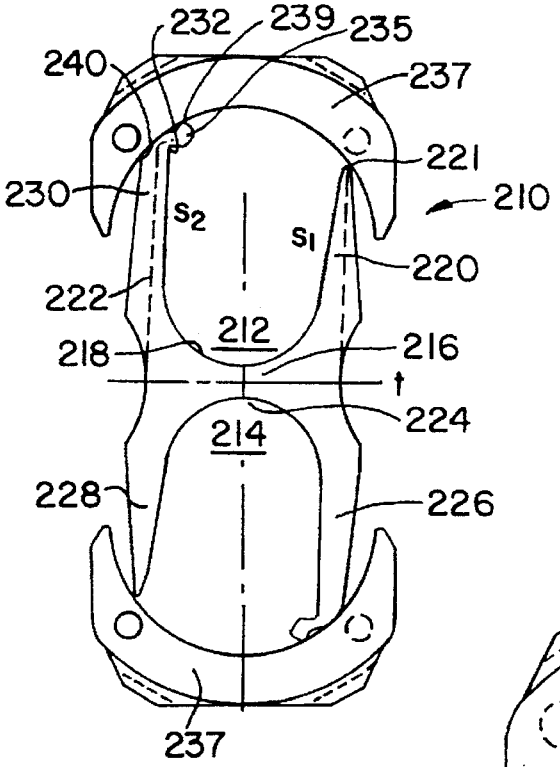
FIG. 8 shows an additional embodiment of an improved compression connector of the present invention.

Referring now to FIG. 8, an additional embodiment of the compression connector of the present invention is shown. Compression connector 210 is of construction similar to that shown and described above, having a generally H-shaped cross-section providing oppositely directed upper and lower conductor receiving nests 212 and 214 separated by a cross member 216. Conductor receiving nest 212 is defined by a bottom wall 218 and a pair of upstanding sidewalls 220 and 222. In a similar manner, nest 214 is defined by a bottom wall 224 and opposed sidewalls 226 and 228. Sidewalls 222 and 226, which are diametrically opposed, are constructed to have lengths which are longer than opposite sidewalls 220 and 228.

Again, for ease of description reference will be made only to nest 212 at the upper half of connector 220 it being understood that the lower is formed in a manner similar thereto. Longer sidewall 222 includes an inwardly directed die engagement extent 235 adjacent a distal extent 230 of sidewall 222. Distal extent 230 is weakened at an angled portion 232 thereof forming die engagement extent 235. In the present embodiment, angled portion 232 permits die engagement extent 235 to extend at an angle of approximately 90° to the remainder of sidewall 222. As described above, with respect to the previous embodiments, this weakened portion of distal extent 230 permits sidewall 222 to be inwardly deformed prior to the deformation of opposed sidewall 220 upon application of a crimping force. However, also as described above, weakened portion 232 is sufficiently rigid to resist manual bending thereat. It is only upon the application of a crimping force applied by die 237, that sidewall 222 will be subject to inward deformation. Also the distance that die engagement extent 235 extends toward opposed sidewall 220 is sufficiently small so as to permit the unimpeded insertion of a conductor into nest 212.

Die engagement extent 235 further includes a die engagement rib 239 which extends outwardly from sidewall 222. Die engagement rib 239 extends into contact engagement with an inner surface of die 237 as above described, to make initial contact therewith upon crimping movement of dies 237.

Further, with respect to the embodiment shown in FIG. 8, as sidewall 222 is constructed to be longer than sidewall 220, an additional die engagement location 240 is formed adjacent distal extent 230. As shown in FIG. 8, opposed sidewall 220 makes initial engagement with die 237 at a distal tip 221 thereof. Distal tip 221 is located a distance $S_1$ from the transverse axis t of connector 210. Additional die engagement location 240 which is more proximal than die engagement rib 239, is located a distance $S_2$ from transverse axis t. As sidewall 222 is constructed to be longer than sidewall 220, distance $S_2$ is greater than distance $S_1$. Thus, upon initial application of a crimping force, dies 237 will engage sidewall 222 at at least two longitudinally spaced locations therealong prior to initial engagement of die 237 with distal tip 221 of sidewall 220. This will provide further assurance that sidewall 222 will deform inwardly prior to the inward deformation of sidewall 220. This is especially critical in situations where different diameter conductors will be located within nest 212. Thus, within a given range of conductor sizes, sidewall 222 is constructed to be overlapped by opposed sidewall 220 during crimping.

Referring now to FIGS. 9 and 10, successive steps in the crimping cycle may be seen. Conductor 245 is supported within nest 212. A conventional crimping tool (not shown) employing dies 237 exerts a uniform crimping force on sidewalls 220 and 222. Upon initial application of this crimping force, sidewall 222 will inwardly deform prior to the inward deformation of sidewall 220.

As can be seen in FIG. 9, die engagement extent 235 will be caused to deform both inwardly and downwardly towards cross member 216. Rib 239 facilitates the downward deformation of die engagement extent 235 about weakened portion 232. Further, as contact is also made between die 237 and additional die engagement location 240, significant inward deformation of sidewall 222 will be achieved prior to deformation of opposed sidewall 220. Continued application of a crimping force causes deformation of sidewall 220, the tip 221 of which is caused to ride over inwardly deformed die engagement extent 235 which has been so deformed due to engagement between rib 239 and die 237.

As shown in FIG. 10, the completely crimped connector 210 shows significant overlap between the distal tip 221 of sidewall 220 and die engagement extent 235. Conductor 245 shown in FIG. 10, represents the largest of the range of conductors which can be accommodated in connector 210. However, it can be seen that even with this largest conductor, complete encirclement of conductor 245 is achieved. It can be appreciated that if a smaller conductor is employed within nest 212 even further overlap of sidewalls 220 and 222 will be achieved.

Figure 11:
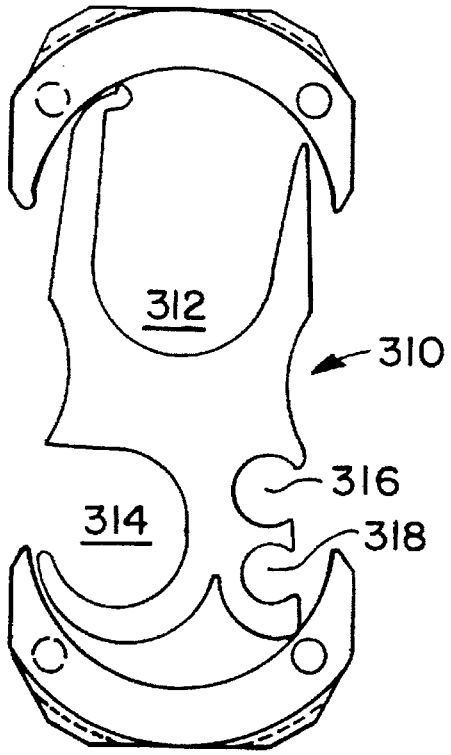
FIG. 11 shows a still further embodiment of an improved compression connector of the present invention.

Referring now to FIG. 11, a still further embodiment of the present invention is shown. Compression connector 310 includes an upper conductor receiving nest 312 which is substantially similar to nest 212 shown in FIG. 8–10. The compression connection of a conductor in nest 312 is achieved in substantially the same manner as described above. The lower half of connector 310 is not of the general H-shaped configuration. Connector 310 includes additional conductor receiving nests 314, 316 and 318 which provide for accommodation of additional conductors. These conductor nests are generally formed in the sidewalls and permit side or lateral entry of conductors thereinto. Connector 310 permits accommodation of more than two conductors in a single connector configuration. Thus while the present invention is described primarily with respect to connectors of the H-tap variety, the principles of the present invention are not limited thereto and may be practiced with compression connectors of various connector configurations.

Various changes to the foregoing described and shown structures would now be evident to those skilled in the art. Accordingly, the particularly disclosed scope of the invention is set forth in the following claims.

What is claimed is:

1. An electrical connector for crimpable connection about an electrical conductor upon application of a crimping force imparted by a die of a crimping tool, said connector comprising:

a connector body having a bottom wall and a pair of spaced apart upstanding elongate deformable sidewalls, said bottom wall and said sidewalls defining interiorly thereof an open ended conductor receiving nest;

one said sidewall including at the distal end thereof a non-bendable manually initial die engagement extent, said initial die engagement extent extending toward said other sidewall a distance sufficiently small so as to permit unimpeded conductor insertion into said nest, said initial die engagement extent being attached to said distal end of said one sidewall by a weakened wall portion, said weakened wall portion facilitating crimping deformation of said side wall thereat while preventing manual bending thereat;

said initial die engagement extent including a die engagement rib extending outwardly from said one sidewall, said initial die engagement rib being engagable with said die to cause said weakened portion to deform and said die engagement extent to move toward said conductor nest upon application of said crimping force.

2. An electrical connector of claim 1 wherein said weakened portion of said one sidewall includes said one sidewall having a reduced wall thickness thereat.

3. An electrical connector of claim 1 wherein said weakened portion of said one sidewall includes a v-shaped groove therein.

4. An electrical connector of claim 1 wherein said weakened portion of said one sidewall includes said sidewall being angularly bent thereat.

5. An electrical connector of claim 1 wherein said sidewalls are constructed to have sufficient length to overlap about said conductor upon said application of said crimping force.

6. An electrical connector of claim 5 wherein the other sidewall is constructed to overlap said initial die engagement extent of said one sidewall.

7. An electrical connector of claim 5 wherein said conductor nest is constructed to accommodate conductors of different diameters.

8. An electrical connector of claim 1 wherein said connector body has an H-shaped configuration including a first pair of said spaced apart sidewalls extending from said bottom wall and a second pair of said spaced apart sidewalls extending from said bottom wall in a direction opposite said first pair of sidewalls.

9. An electrical connector of claim 8 wherein said one sidewall of each of said first and second pairs of sidewalls is located diagonally opposite one another.

10. An electrical connector of claim 1 wherein said one sidewall includes an additional contacting portion proximate of said distal end thereof, said one sidewall being constructed such that said initial die engagement extent and said additional die contacting portion engage said die prior to deformable engagement of said die with said other sidewall.

* * * * *